US008417140B2

(12) United States Patent
Matsuzaki

(10) Patent No.: US 8,417,140 B2
(45) Date of Patent: Apr. 9, 2013

(54) IMAGE FORMING APPARATUS AND IMAGE FORMING METHOD

(75) Inventor: Yoshiki Matsuzaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 232 days.

(21) Appl. No.: 12/871,620

(22) Filed: Aug. 30, 2010

(65) Prior Publication Data

US 2011/0123235 A1 May 26, 2011

(30) Foreign Application Priority Data

Nov. 24, 2009 (JP) ..... 2009-266386

(51) Int. Cl.
*G03G 15/01* (2006.01)

(52) U.S. Cl.
USPC ..... 399/82; 399/301; 399/302

(58) Field of Classification Search ..... 399/82, 399/81, 13, 298, 299, 301, 302
See application file for complete search history.

(56) References Cited

U.S. PATENT DOCUMENTS 6,061,542 A 5/2000 Minami et al.
6,104,891 A 8/2000 Maebashi et al.
6,738,594 B2 * 5/2004 Nakagawa et al. ..... 399/299
6,941,102 B2 9/2005 Sasamoto et al.
2005/0163515 A1 * 7/2005 Inukai ..... 399/12
2006/0127140 A1 * 6/2006 Miyake ..... 399/299
2011/0122461 A1 * 5/2011 Tanaka et al. ..... 358/474

FOREIGN PATENT DOCUMENTS

JP 3731023 B2 10/2005
JP 3799763 B2 7/2006
JP 4154031 B2 9/2008

* cited by examiner

*Primary Examiner* — Sophia S Chen
(74) *Attorney, Agent, or Firm* — Sughrue Mion, PLLC

(57) ABSTRACT

An image forming apparatus includes toner-image forming units, an intermediate transfer body, a controller, a detector, an instruction acceptance unit, and a memory. The toner-image forming units form toner images. The toner images are transferred onto the intermediate transfer body. The controller performs control of causing, among the toner-image forming units, one or multiple toner-image forming units to be used to form the toner images to contact the intermediate transfer body, and of separating the other toner-image forming units from the intermediate transfer body. The detector detects a test pattern formed by the toner forming units. The instruction acceptance unit accepts an instruction for performing a detection process with the detector. The memory stores, among forming modes indicating combinations of toner-image forming units to be used, a first forming mode for forming an image and a second forming mode for forming the test pattern.

6 Claims, 11 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2009-266386 filed Nov. 24, 2009.

BACKGROUND (i) Technical Field

The present invention relates to an image forming apparatus and an image forming method.

(ii) Related Art

It is known that, in image forming apparatuses that form a color image by forming images having multiple colors with respective toners of the colors and by superimposing the images having the individual colors on one another, color misregistration of the color image transferred onto a recording sheet is caused by relative misregistration of the images having the individual colors.

SUMMARY

According to an aspect of the invention, there is provided an image forming apparatus including multiple toner-image forming units, an intermediate transfer body, a controller, a detector, an instruction acceptance unit, and a memory. The multiple toner-image forming units form electrostatic latent images on image carriers by performing exposure in accordance with image data which is supplied, and that form toner images by developing the electrostatic latent images. The toner images formed by the multiple toner-image forming units are transferred onto the intermediate transfer body. The controller performs control of causing at least one of the multiple toner-image forming units to be used to form the toner images and the intermediate transfer body to contact each other, and control of separating the multiple toner-image forming units except the at least one of the multiple toner-image forming units and the intermediate transfer body from each other. The detector detects a test pattern formed by the multiple toner-image forming units. The instruction acceptance unit accepts an instruction for performing a detection process with the detector. The memory stores a first forming mode, which is used to form an image, among multiple forming modes indicating combinations of toner-image forming units to be used to form the toner images among the multiple toner-image forming units, and stores a second forming mode, which is used to form the test pattern, among the multiple forming modes. When the instruction acceptance unit accepts the instruction, the test pattern is formed using at least one of the multiple toner-image forming units corresponding to the second forming mode stored in the memory, and is detected by the detector.

BRIEF DESCRIPTION OF THE DRAWINGS

An exemplary embodiment of the present invention will be described in detail based on the following figures, wherein.

DETAILED DESCRIPTION

Configuration

Figure 1:
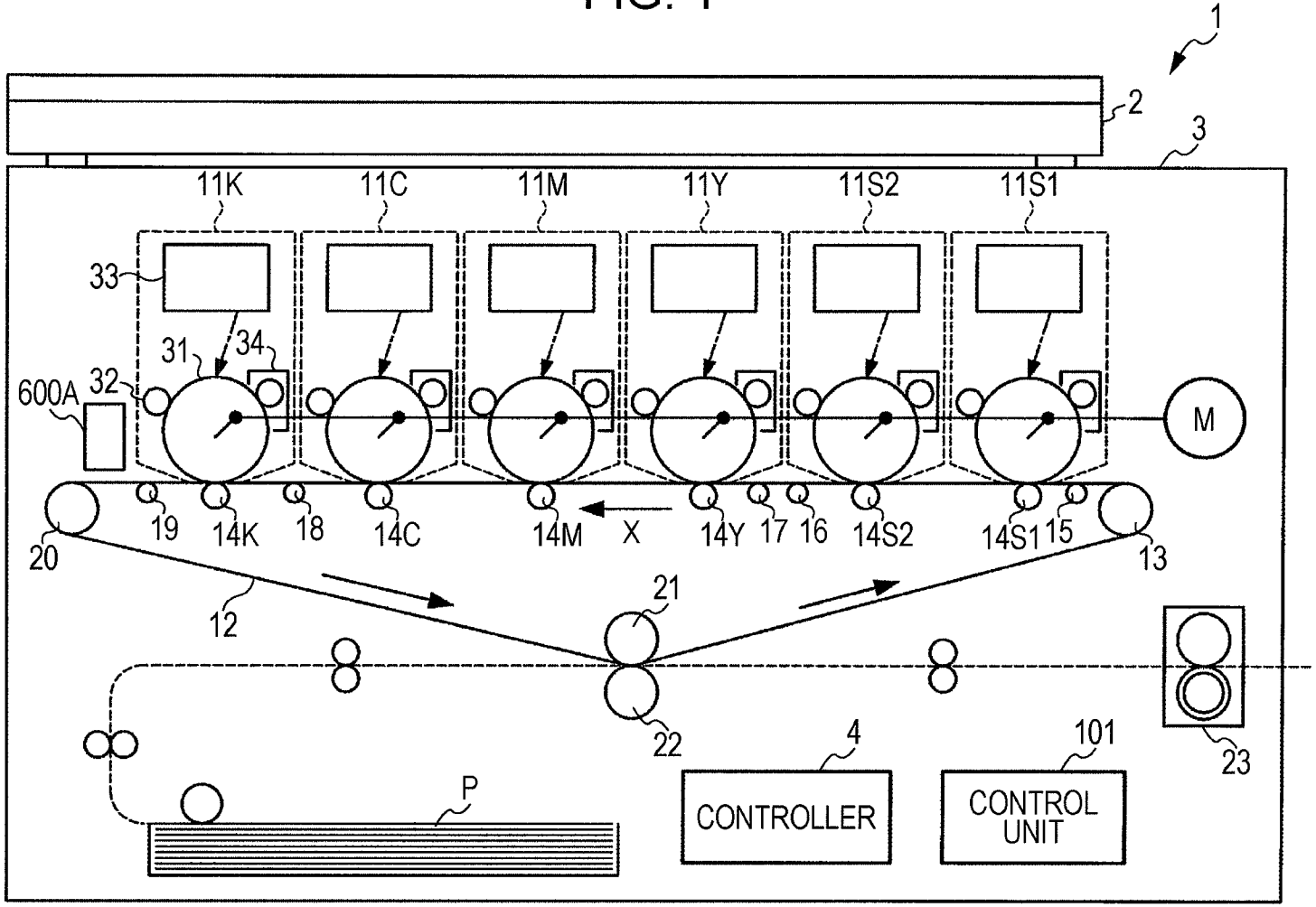
FIG. 1 is a schematic diagram of an image forming apparatus according to an exemplary embodiment.

FIG. 1 is a diagram of an overall configuration of an image forming apparatus according to a present exemplary embodiment. As illustrated in FIG. 1, an image forming apparatus 1 includes a scanner section 2, an image forming section 3, and a control unit 101 that performs overall management and control of an operation of each of the scanner section 2 and the image forming section 3. Hereinafter, the details of each of the sections will be described.

The scanner section 2 irradiates a read target, such as a sheet, with light, and reads, using an image sensor, light reflected by the read target as a data item. The scanner section 2 transmits the read data item to the control unit 101 or to a personal computer (PC) that is connected to the scanner section 2.

The image forming section 3 includes a controller 4 that accepts a print data item which has been transmitted from a PC or the like via a communication interface (not illustrated), and that generates raster-image data items. The image forming section 3 forms images in accordance with the raster-image data items that have been generated by the controller 4. Note that the print data item is written in, for example, a page description language (PDL), and commands and so forth that are included in the print data item are interpreted and converted into the raster-image data items by the controller 4. The image forming section 3 is configured to form images having two specific colors (a first specific color S1 and a second specific color S2) in addition to four colors, i.e., yellow (Y), magenta (M), cyan (C), and black (K). In the present exemplary embodiment, a toner of a clear (transparent) color as the first specific color S1 is used, and a toner of a low gloss black as the second specific color S2 is used. The image forming section 3 performs an image forming process in a forming mode (hereinafter, referred to as a "color mode") that is interpreted and determined by the controller 4. As color modes in the present exemplary embodiment, multi-color modes, in which an image is formed using two or more colors among the six colors, and a single-color mode, in which an image is formed using a single color such as black, are set.

Color modes that are defined as the multi-color modes are as follows: a six-color mode in which an image is formed using the six colors; a five-color mode in which an image is formed using five colors including YMCK and either one of the first specific color S1 and the second specific color S2; a four-color mode in which an image is formed using the four colors, i.e., YMCK; and a two-color mode in which an image is formed using the two specific colors. Regarding the five-color mode, two types of five-color modes, i.e., a five-color mode in which the first specific color S1 is included and a five-color mode in which the second specific color S2 is included, are defined. Note that, as each of the first specific color S1 and the second specific color S2, for example, an invisible toner, a toner of a corporate color dedicated to a specific user (for example, green for a specific film company or red for a specific beverage company), a foaming toner used for Braille, a toner for improving a highlight color or gloss, or the like may be used. Furthermore, although a configuration in which two types of specific colors are provided is used in the present exemplary embodiment, the configuration is not limited thereto. One type of specific color, three types of specific colors, or four or more types of specific colors may be provided. Hereinafter, the individual units of the image forming section 3 will be described. Note that configurations associated with the individual colors, i.e., yellow (Y), magenta (M), cyan (C), black (K), the first specific color S1, and the second specific color S2 will be described using symbols Y, M, C, K, S1, and S2, respectively, which denote the individual colors and attached to the configurations.

Image forming units 11Y, 11M, 11C, 11K, 11S1, and 11S2 (hereinafter, simply referred to as "image forming units 11" when the individual image forming units are not distinguished from one another) form toner images having yellow (Y), magenta (M), cyan (C), black (K), the first specific color S1, and the second specific color S2. As illustrated in FIG. 1, the image forming units 11 for the individual colors are provided in the order of S1, S2, Y, M, C, and K from the upstream side to the downstream side of a transport direction, which is an X direction indicated by the arrows, of an intermediate transfer belt 12 so that the image forming units 11 are detachably attached using attachment parts thereof.

Each of the image forming units 11 includes the following elements: a photoconductor drum 31 that is provided as an example of an image carrier having a photosensitive layer; a charger 32 that causes the surface of the photoconductor drum 31 to become charged; an exposure device 33 that is provided as a light irradiation part which exposes the photoconductor drum 31 to light to form an electrostatic latent image on the photoconductor drum 31; and a developing device 34 that develops the electrostatic latent image formed on the photoconductor drum 31 to form a toner image on the photoconductor drum 31.

The radii of the photoconductor drums 31 for the individual colors in the present exemplary embodiment are the same. The individual photoconductor drums 31 are disposed so that distances (hereinafter, referred to as "drum-to-drum distances") between first transfer positions of the photoconductor drums 31 adjacent to each other are the same. As each of the exposure devices 33, a type of exposure device that forms an electrostatic latent image on a corresponding one of the photoconductor drums 31 by scanning the photoconductor drum 31 with laser light in the main scanning direction is used. Furthermore, the exposure devices 33 and the photoconductor drums 31 in the present exemplary embodiment have common relative positional relationships therebetween in the image forming units 11 for the individual colors. In other words, on the photoconductor drums 31, positions at which laser light emitted from the exposure devices 33 is received are the same in the individual image forming units 11. Note that, as each of the exposure devices 33, a type of exposure device in which multiple light-emitting elements are disposed in an array form in the main scanning direction of a corresponding one of the photoconductor drums 31 and in which the light-emitting elements are caused to flash light toward the photoconductor drum 31 may be used.

Electrostatic latent images having the individual colors in the present exemplary embodiment are formed so that the edges thereof are aligned in a sub-scanning direction on a sheet (or on the intermediate transfer belt 12). In order to align the electrostatic latent images having the individual colors, which have been formed on the photoconductor drums 31 for the individual colors, on the intermediate transfer belt 12, times at which writing of the electrostatic latent images onto the photoconductor drums 31 starts for the individual colors are shifted from each other. For example, regarding the two photoconductor drums 31 adjacent to each other, writing of the electrostatic latent image onto the photoconductor drum 31 on the downstream side starts a time $\Delta t$ after writing of the electrostatic latent image onto the photoconductor drum 31 on the upstream side has started. Note that the time $\Delta t$ can be determined using the drum-to-drum distance. More specifically, the time $\Delta t$ has a relationship the drum-to-drum distance (L)/the peripheral velocity (v) of the intermediate transfer belt 12. As described above, when one of the photoconductor drums 31 is considered as a start point, a time at which writing of the electrostatic latent image onto a certain one of the photoconductor drums 31 starts can be determined using the drum-to-drum distance between the photoconductor drum 31 and the photoconductor drum 31 that is considered as a start point. Furthermore, in the present exemplary embodiment, the image forming unit 11 that is located at the most upstream position in the transport direction of the intermediate transfer belt 12 is considered as a start point among the image forming units 11 that practically perform image forming, and times at which writing of the electrostatic latent images onto all of the photoconductor drums 31 starts are determined using the start point. For example, in the six-color mode in which image forming is performed using the six image forming units 11, the image forming unit 11YS1 for the first specific color S1 that is located at the most upstream position is considered as a start point for determining times at which writing of the electrostatic latent images onto all of the photoconductor drums 31 starts. Furthermore, in the four-color mode in which image forming is performed using the four colors, i.e., Y, M, C and K, the image forming unit 11Y for yellow that is located at the most upstream position is considered as a start point for determining times at which writing of the electrostatic latent images onto all of the photoconductor drums 31 starts.

Next, the intermediate transfer belt 12 will be described. The intermediate transfer belt 12 is formed in the shape of an endless belt by, for example, forming a band-shaped flexible synthetic-resin film made of polyimide or the like and by connecting the ends of the band-shaped synthetic-resin film to each other by welding or the like. The intermediate transfer belt 12 is stretched around a belt driving unit 13 and rolls 20 and 21 with a certain tension applied thereto, and is rotated by the belt driving unit 13 at a certain speed in the X direction indicated by the arrows. The toner images having the above-described individual colors, which have been formed on the respective photoconductor drums 31, are transferred onto the intermediate transfer belt 12, which serves as an intermediate transfer body (medium) disposed below the individual image forming units 11, by the respective first transfer rolls 14Y, 14M, 14C, 14K, 14S1, and 14S2 so that the toner images are superimposed on one another. Hereinafter, transfer of the toner images onto the intermediate transfer belt 12 is referred to as "first transfer.

The first transfer rolls 14Y, 14M, 14C, 14K, 14S1, and 14S2 (hereinafter, simply referred to as "first transfer rolls 14" when the individual first transfer rolls are not distinguished from one another) are provided at positions at which the individual first transfer rolls face the respective photoconductor drums 31 on the rear surface side of the intermediate transfer belt 12. Furthermore, movement mechanisms (not illustrated) are connected to the individual first transfer rolls 14. The movement mechanisms move, in accordance with the above-described color modes, the individual first transfer rolls 14 in a direction (the downward direction in FIG. 1) in which the first transfer rolls 14 are separated from the photoconductor drums 31, or in a direction (the upward direction in FIG. 1) in which the intermediate transfer belt 12 is pressed against the photoconductor drums 31.

In the present exemplary embodiment, in order to prevent the photoconductor drums 31 and the intermediate transfer belt 12 from being deteriorated by friction between the photoconductor drums 31 and the intermediate transfer belt 12, which is caused by performing transport in a state in which the photoconductor drums 31 that are not used in the color modes are in contact with the intermediate transfer belt 12, the photoconductor drums 31 of the image forming units 11 that are used and the intermediate transfer belt 12 are caused, in accordance with the color modes, to contact each other, and the photoconductor drums 31 that are not used and the intermediate transfer belt 12 are separated from each other.

More specifically, in accordance with the color modes, only the photoconductor drums 31 of the image forming units 11 that are used and the corresponding first transfer rolls 14 that are disposed so as to face the photoconductor drums 31 are moved in the upward direction, and a first transfer bias is applied. Accordingly, when the intermediate transfer belt 12 is transported to the positions of the first transfer rolls 14, first transfer of the toner images that have been formed on the photoconductor drums 31 is performed. Furthermore, the photoconductor drums 31 of the image forming units 11 that are not used and the corresponding first transfer rolls 14 that are disposed so as to face the photoconductor drums 31 are moved by the movement mechanisms in the downward direction. The intermediate transfer belt 12 is transported in a state in which the intermediate transfer belt 12 is separated, at the positions of the first transfer rolls 14, from the photoconductor drums 31 that are not used.

Retract rolls 15 to 19 are provided on the rear surface side of the intermediate transfer belt 12 as in the case of the first transfer rolls 14. Movement mechanisms (not illustrated) are connected to the retract rolls 15 to 19, and perform, on the retract rolls 15 to 19, movement control which is similar to that performed on the first transfer rolls 14. The retract rolls 15 to 19 are moved in the upward/downward directions in accordance with the color modes.

Figure 2A:
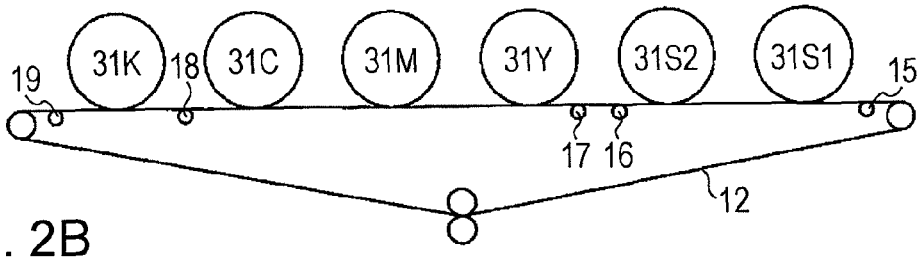
FIGS. 2A to 2F are diagrams for explaining positional relationships between an intermediate transfer belt and photoconductor drums in various types of color modes in the exemplary embodiment.
Figure 2B:
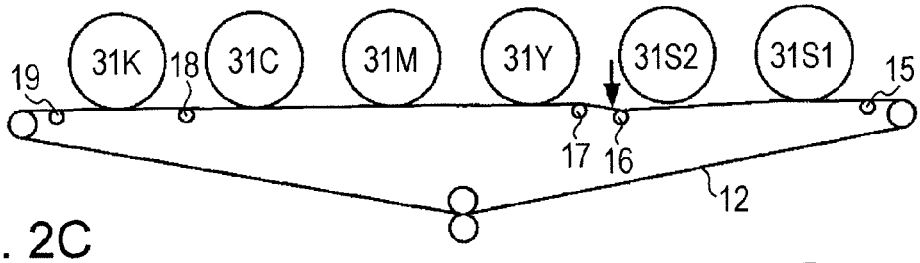
Figure 2C:
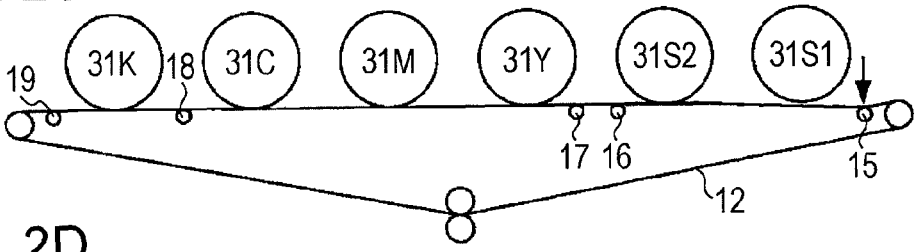

In this example, in the six-color mode, as illustrated in FIG. 2A, the retract rolls 15 to 19 are moved in the upward direction so as to press the intermediate transfer belt 12 against the individual photoconductor drums 31. Furthermore, in the five-color mode (hereinafter, referred to as a "five-color mode #1") in which five colors, i.e., the first specific color S1 and YMCK, are used, as illustrated in FIG. 2B, the retract roll 16 is moved in the downward direction so that the photoconductor drums 31Y, 31M, 31C, 31K, and 31S1 contact the intermediate transfer belt 12 and the photoconductor drum 31S2 and the intermediate transfer belt 12 are separated from each other. Moreover, in the five-color mode (hereinafter, referred to as a "five-color mode #2") in which five colors, i.e., the second specific color S2 and YMCK, are used, as illustrated in FIG. 2C, the retract roll 15 is moved in the downward direction so that the photoconductor drums 31Y, 31M, 31C, 31K, and 31S2 contact the intermediate transfer belt 12 and the photoconductor drum 31S1 and the intermediate transfer belt 12 are separated from each other.

Figure 2D:
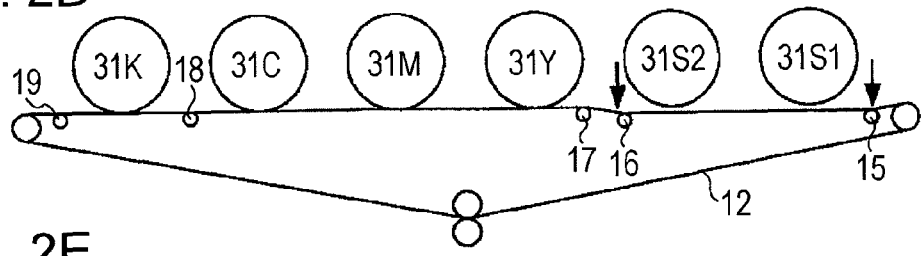
Figure 2E:
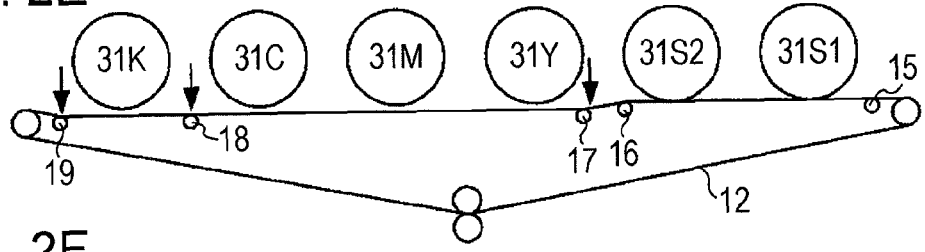
Figure 2F:
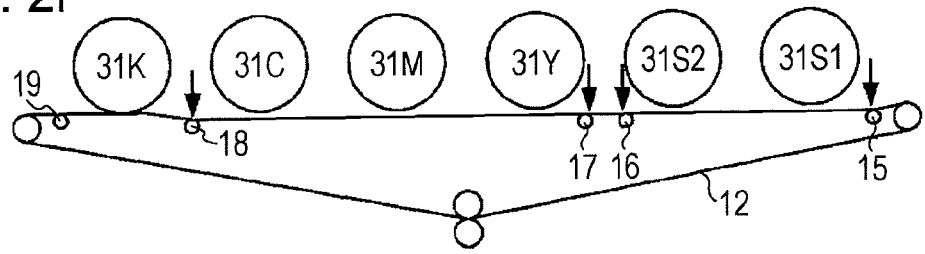

In the four-color mode, as illustrated in FIG. 2D, the retract rolls 15 and 16 are moved in the downward direction so that the photoconductor drums 31Y, 31M, 31C, and 31K contact the intermediate transfer belt 12 and the photoconductor drums 31S1 and 31S2 and the intermediate transfer belt 12 are separated from each other. Furthermore, in the two-color mode for the first specific color S1 and the second specific color S2, as illustrated in FIG. 2E, the retract rolls 17, 18, and 19 are moved in the downward direction so that the photoconductor drums 31S1 and 31S2 contact the intermediate transfer belt 12 and the photoconductor drums 31Y, 31M, 31C, and 31K are separated from the intermediate transfer belt 12. Moreover, as illustrated in FIG. 2F, in the single-color mode for black, the retract rolls 15, 16, 17, and 18 are moved in the downward direction so that only the photoconductor drum 31K contacts the intermediate transfer belt 12.

Note that, although the first transfer rolls 14 are not illustrated in FIGS. 2A to 2F described above, the first transfer rolls 14 that are provided at positions at which the first transfer rolls 14 face the photoconductor drums 31 that are used in the individual color modes are also moved in the downward direction as in the case of the retract rolls.

Returning to FIG. 1, the description continues. The toner images having the individual colors, which have been transferred onto the intermediate transfer belt 12 in the above-described manner, are transferred onto a sheet P, which has been transported, by a second transfer roll 22, which is pressed against the roll 21 side (hereinafter, transfer of the toner images onto the sheet P being referred to as "second transfer"). Note that, when the sheet P is transported between the second transfer roll 22 and the roll 21, which is provided on the inner side of the intermediate transfer belt 12, a second transfer bias having a polarity that is opposite to the polarity of toner which has been transferred onto the intermediate transfer belt 12 using first transfer is applied to the second transfer roll 22. Accordingly, an electrostatic force in the direction from the intermediate transfer belt 12 to the sheet P influences the toner on the intermediate transfer belt 12. The toner images are transferred using second transfer onto the surface of a recording medium (hereinafter, referred to as the "sheet P") such as a sheet or an overhead projector (OHP) sheet, thereby forming an image on the sheet P.

The sheet P, on which an image is formed by transferring the toner images having the individual colors using second transfer, is transported to a fixing device 23. After the sheet P is subjected by the fixing device 23 to a fixing process with heat and pressure, the sheet P is ejected to the outside. Note that, after an image is formed on the sheet P, residual toner on the intermediate transfer belt 12 is removed by a belt cleaner that is not illustrated.

As described above, in the present exemplary embodiment, control of moving some of the first transfer rolls 14 and the retract rolls 15 to 19 in the upward/downward directions is performed by the control unit 101, which is described below, in accordance with the color modes that are used when image forming is performed. Accordingly, when image forming is performed in the color modes except the single-color mode, the tension applied to the intermediate transfer belt 12 changes due to this control, and the distances between the photoconductor drums 31 change. Thus, when an image is formed by transferring the toner images onto the sheet P using second transfer, color misregistration occurs.

Color misregistration is an element that influences the quality of a printed image. It is necessary to reduce color misregistration by detecting misregistration of images having the individual colors and by correcting image forming positions. Two modes, which are broadly classified, exist as methods for controlling correction of color misregistration. One of the two modes is an automatic correction control mode in which whether or not correction of color misregistration will be controlled in certain start conditions (the time, the number of sheets to be output, and the temperature inside an apparatus) is determined at a time at which the power is turned on, at a time at which printing starts, during printing, or at a time at which printing finishes. The other mode is a manual correction control mode in which correction of color misregistration is controlled in accordance with an instruction provided by a user in a standby state in which no printing operation is performed.

In the present exemplary embodiment, a case will be described, in which misregistration of toner images having the individual colors on the intermediate transfer belt 12 is detected in accordance with a user instruction, and in which a process of correcting the image forming positions of image data items that are to be transferred onto the sheet P.

Figure 3:
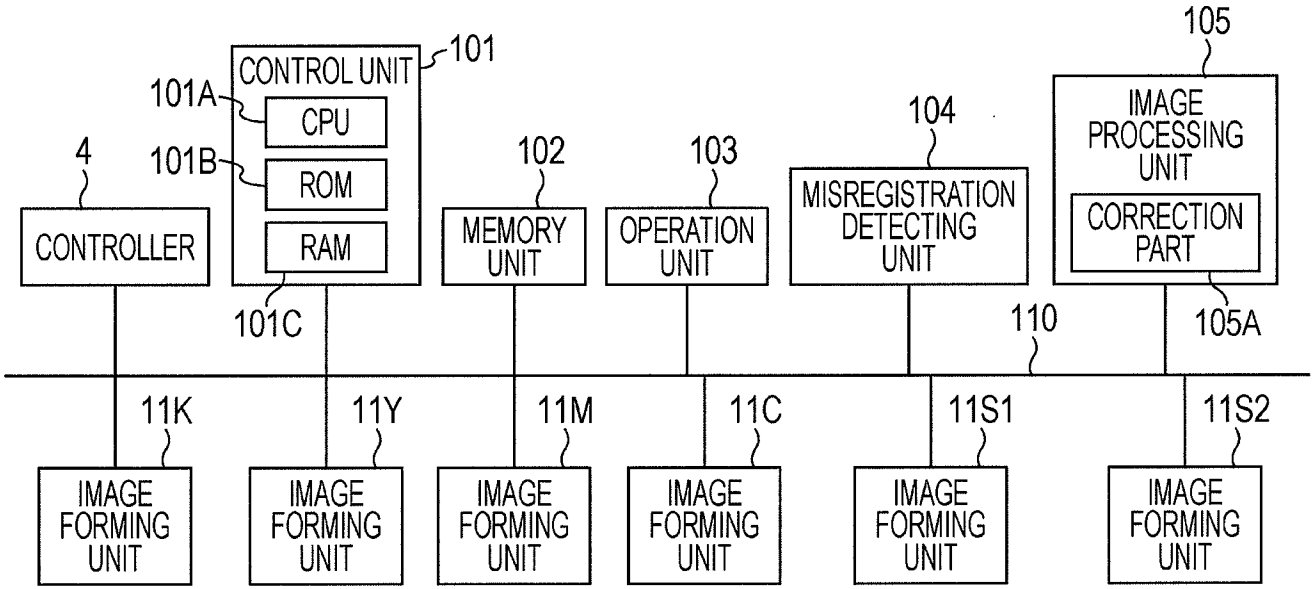
FIG. 3 is a block diagram of a configuration of the image forming apparatus according to the exemplary embodiment.

The image forming apparatus 1 has a configuration for performing a typical image forming process, and a misregistration detection and correction process of detecting misregistration in accordance with the color modes, and of correcting the image forming positions of images that are to be transferred onto the sheet P. FIG. 3 is a block diagram of a configuration of the image forming apparatus 1 in a case in which these processes are performed. As illustrated in FIG. 3, the image forming apparatus 1 includes the control unit 101, a memory unit 102, an operation unit 103, a misregistration detecting unit 104, an image processing unit 105, the image forming units 11K, 11Y, 11M, 11C, 11S1, and 11S2, and the above-described controller 4. The individual units are connected to each other via lines 110.

The control unit 101 includes a central processing unit (CPU) 101A, a read-only memory (ROM) 101B, and a random-access memory (RAM) 101C. A control program is stored in the ROM 101B. The CPU 101A executes the control program using the RAM 101C as a working area, thereby controlling the individual units of the image forming apparatus 1, so that the image forming apparatus 1 operates. More specifically, the control unit 101 outputs, to the individual movement mechanisms (not illustrated), in accordance with a color mode of which the controller 4 has notified the control unit 101, control signals for providing instructions for moving the first transfer rolls 14 and the retract rolls 15 to 19. In addition, the control unit 101 supplies, to the image forming units 11, image data items regarding test patterns that are to be used when detection of misregistration is performed. The control unit 101 transfers toner images of the test patterns onto the intermediate transfer belt 12 using first transfer, and performs a misregistration detection process. The control unit 101 corrects, on the basis of a detection result, the image forming positions of image data items that are to be transferred onto the sheet P.

The memory unit 102 is configured using a non-volatile storage medium. The memory unit 102 stores image data items (hereinafter, referred to as "pattern image data items") regarding test patterns that are provided in accordance with the individual color modes except the single-color mode, and data items regarding various types of setting information items including a color mode information item concerning a color mode that is set as the default by the user and so forth. Note that, in the present exemplary embodiment, the four-color mode (YMCK) is stored as a color mode information item concerning a color mode that is set as the default, and pattern image data items for the individual colors that are used in the individual color modes except the single-color mode are stored on a color-mode-by-color-mode basis.

The operation unit 103 includes, for example, a touch-panel display device. The operation unit 103 displays a menu screen or messages for providing an instruction (hereinafter, referred to as a "misregistration correction instruction") for detecting misregistration and for correcting the image forming positions for an image that is to be formed on the sheet P, and accepts an instruction from the user. Note that, in the present exemplary embodiment, when provision of the misregistration correction instruction is performed, a color mode may be specified in the misregistration correction instruction. An information item indicating colors corresponding to the specified color mode is displayed, in a screen for accepting the misregistration correction instruction, in a form that can be recognized by the user. For example, the colors corresponding to the six-color mode are displayed in a form, such as a form of "Y+M+C+T+CT+LGK", in which CT representing the toner of the first specific color S1 (a clear color), LGK representing the toner of the second specific color S2 (a low gloss color), and YMCK are combined with one another.

Figure 4:
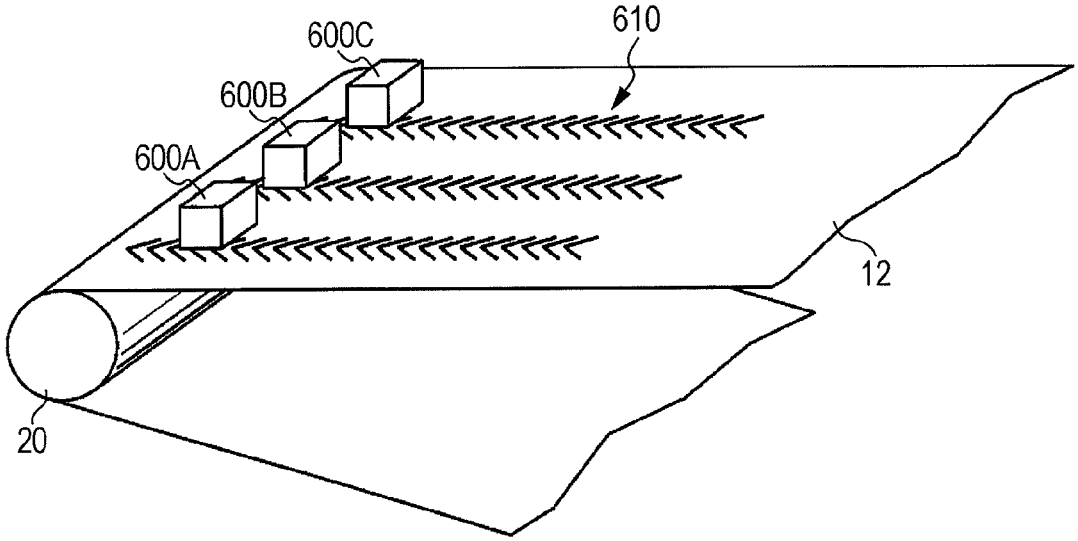
FIG. 4 is a diagram for explaining detection of test patterns in the exemplary embodiment.

The misregistration detecting unit 104 is a unit that detects the test patterns which have been transferred onto the intermediate transfer belt 12 in order to detect misregistration of transfer positions for transfer onto the intermediate transfer belt 12. The misregistration detecting unit 104 includes test-pattern detectors 600A, 600B, and 600C (hereinafter, referred to as "test-pattern detectors 600" when the individual test-pattern detectors are not distinguished from one another) that detect toner images of the test patterns. Herein, the misregistration detection process in the present exemplary embodiment will be described. FIG. 4 is a conceptual diagram illustrating detection of the toner images of the test patterns, which have been transferred onto the intermediate transfer belt 12 using first transfer, with the test-pattern detectors 600.

In the present exemplary embodiment, as illustrated in FIG. 4, test patterns 610, which are called chevron pattern, for detecting the transfer positions are formed on the intermediate transfer belt 12. The test patterns 610 are detected by the respective test-pattern detectors 600. The test-pattern detectors 600 are located on the downstream side of a moving direction of the intermediate transfer belt 12. Each of the test-pattern detectors 600 is disposed at a measurement reference position, which is predetermined, in a corresponding one of an OUT section (a front section in FIG. 4), a CENTER section (a central section), and an IN section (a rear section in FIG. 4) of the image forming apparatus 1 along the main scanning direction. However, for example, four or more test-pattern detectors 600 may be provided at the same intervals along the direction of the width of the intermediate transfer belt 12.

Furthermore, patterns having various shapes may be used as the test patterns 610. However, in the present exemplary embodiment, chevron-shaped marks that are constituted by toner images of straight lines, which are connected to each other at the center and inclined leftward and rightward at the same angle, are formed so as to correspond to the positions of the test-pattern detectors 600A, 600B, and 600C, and used as the test patterns 610. Moreover, regarding the test patterns 610 in the present exemplary embodiment, one of the colors of toner images that can be formed in the individual color modes except the single-color mode is determined as a reference color, and multiple chevron-shaped marks having the colors corresponding to the individual color modes are formed at predetermined intervals along the sub-scanning direction (the moving direction of the intermediate transfer belt 12).

Figure 5A:
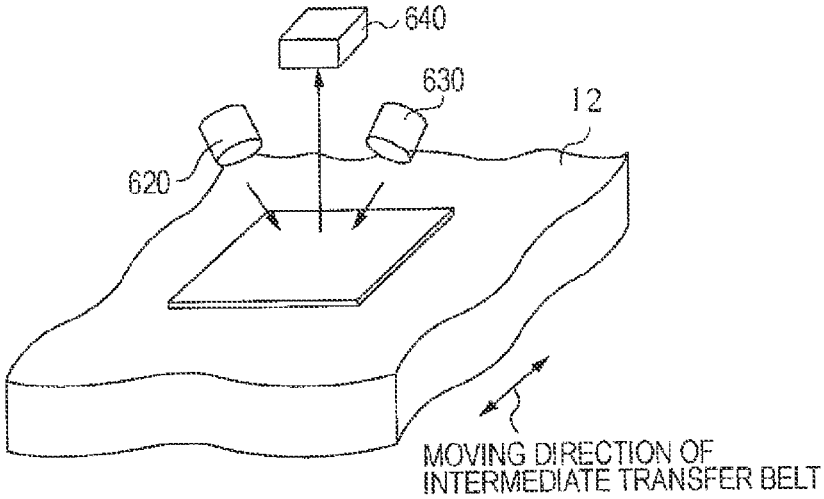
FIG. 5A is a diagram for explaining a configuration of a test-pattern detector in the exemplary embodiment.
Figure 5B:
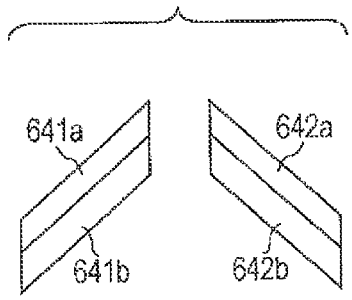
FIG. 5B is a diagram for explaining a configuration of a light receiving unit in the exemplary embodiment.

Next, the configuration of each of the test-pattern detectors 600 that detect the test patterns 610 will be described. FIGS. 5A and 5B are schematic diagrams of the test-pattern detector 600. In FIG. 5A, the test-pattern detector 600 includes light emitting diodes (LEDs) 620 and 630 that emit light toward the intermediate transfer belt 12 in a state in which the LEDs 620 and 630 are inclined at predetermined angles, and a light receiving unit 640.

In the light receiving unit 640, multiple photodiodes, which are light receiving elements, are combined with each other. As illustrated in FIG. 5B, the light receiving unit 640 includes first light receiving elements 641*a* and 641*b* (hereinafter, referred to as "first light receiving elements 641" when the individual first light receiving elements are not distinguished from each other), and second light receiving elements 642*a* and 642*b* (hereinafter, referred to as "second light receiving elements 642" when the individual second light receiving elements are not distinguished from each other). The first light receiving elements 641 and the second light receiving elements 642 are inclined only at a predetermined angle with respect to the outer peripheral face of the intermediate transfer belt 12, and are disposed symmetrically to each other in the left-right direction.

The first light receiving element 641*a* and the second light receiving element 642*a* receive light with which the test patterns 610 formed on the intermediate transfer belt 12 are irradiated and which is reflected by the test patterns 610, and outputs signals that are generated in accordance with the amounts of the reflected light. Note that, when there is no misregistration in the main scanning direction, signals that are generated in accordance with the amounts of reflected light are output from the first light receiving element 641*a* and the second light receiving element 642*a* at the same time. Signals that are generated in accordance with amounts of reflected light are output from the first light receiving element 641*b* and the second light receiving element 642*b* a certain time period after the first light receiving element 641*a* and the second light receiving element 642*a* output the signals.

The misregistration detecting unit 104 compares the individual signals that have been output from the first light receiving elements 641 and the second light receiving elements 642 with a predetermined threshold. While the waveform of each of the signals is lower than the threshold, the misregistration detecting unit 104 outputs a low-level signal as a detection signal, and while the waveform of the signal is equal to or higher than the threshold, the misregistration detecting unit 104 outputs a high-level signal as a detection signal.

The image processing unit 105 performs image processing, such as density adjustment, on raster-image data items that have been generated by the controller 4 and that should be transferred onto the sheet P. Furthermore, regarding the waveform of a detection signal, which has been output from the misregistration detecting unit 104, for the reference color, a correction part 105A detects a detection time interval from when the level of the detection signal changes from a low level to a high level to when the detection signal has the next rising edge. The correction part 105A determines misregistration amounts for the reference color in the main scanning direction and the sub-scanning direction on the basis of the detection time interval. The correction part 105A detects relative misregistration amounts for the individual colors with respect to the misregistration amounts for the reference color on the basis of the intervals, which are set in advance, between the individual chevron-shaped marks of the test patterns 610. The correction part 105A stores the individual misregistration amounts, which have been determined, in the RAM 101C. Then, the correction part 105A corrects, on the basis of the misregistration amounts, the image forming positions of image data items that are used to form an image based on the image data items that have been subjected to image processing by the image processing unit 105 on the sheet P. The correction part 105A transmits the corrected image data items to the respective image forming units 11. Note that, in the present exemplary embodiment, an example in which image data items are corrected on the basis of the misregistration amounts will be described. However, the image forming positions may be corrected using a method such as a method for adjusting exposure positions with imagers.

Operation

Figure 6:
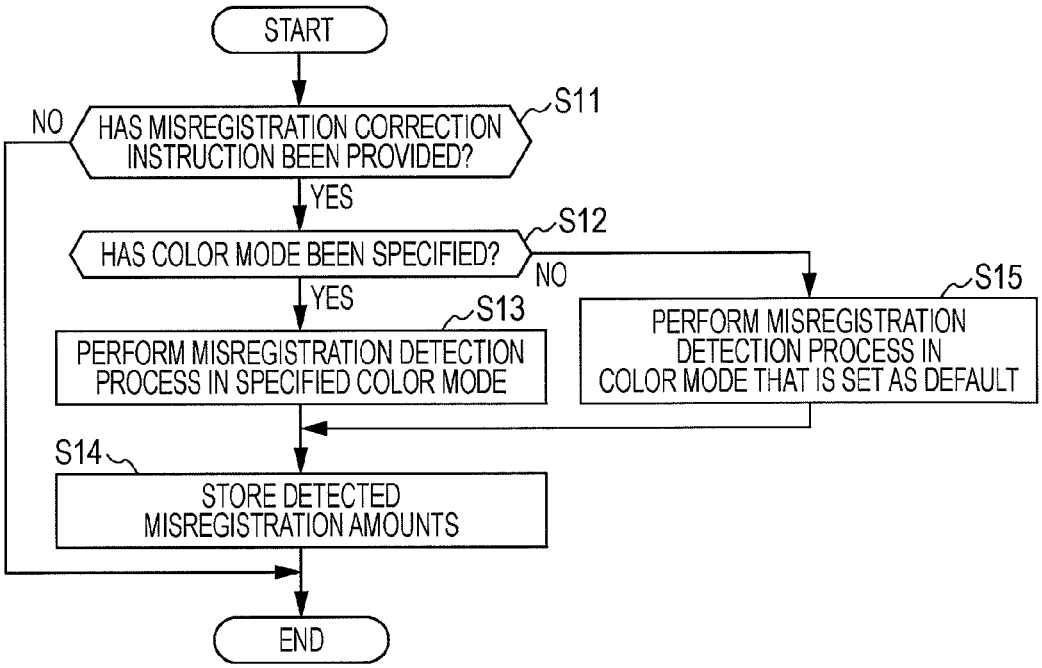
FIG. 6 illustrates an operation flow of an entire operation in a case in which detection of misregistration is performed in the image processing apparatus according to the exemplary embodiment.

Next, an operation of the image forming apparatus 1 according to the present exemplary embodiment will be described. FIG. 6 illustrates an operation flow of an entire operation in a case in which detection of misregistration is performed in the image forming apparatus 1. While the control unit 101 of the image forming apparatus 1 is not performing an image forming process, i.e., while the control unit 101 is being on standby, the control unit 101 accepts, via the operation unit 103, the misregistration correction instruction that is provided by the user (step S11: YES). When a color mode has been specified in the misregistration correction instruction (step S12: YES), the control unit 101 stores the specified color mode in the RAM 101C. The control unit 101 performs movement control on each of the first transfer rolls 14 and the retract rolls 15 to 19 in accordance with the color mode, and performs the misregistration detection process (step S131).

In other words, for example, when the five-color mode #1 is specified, the control unit 101 outputs control signals for moving the photoconductor drum 31S2, which is not to be used in the five-color mode #1, the first transfer roll 14S2, which is disposed so as to face the photoconductor drum 31S2, and the retract roll 16 in the downward direction to the movement mechanisms, which are connected to the individual rolls. Furthermore, the control unit 101 outputs control signals for moving the photoconductor drums 31K, 31C, 31M, 31Y, and 31S1, the first transfer rolls 14K, 14C, 14M, 14Y, and 14S1, which are disposed so as to face the photoconductor drums 31K, 31C, 31M, 31Y, and 31S1, respectively, and the retract rolls 15, and 17 to 19 in the upward direction to the movement mechanisms, which are connected to the individual rolls. Accordingly, the photoconductor drum 31S2 for the second specific color S2 and the intermediate transfer belt 12 are separated from each other, and the photoconductor drums 31K, 31C, 31M, 31Y, and 31S1 corresponding to the five-color mode #1 are caused to contact the intermediate transfer belt 12.

Figure 7:
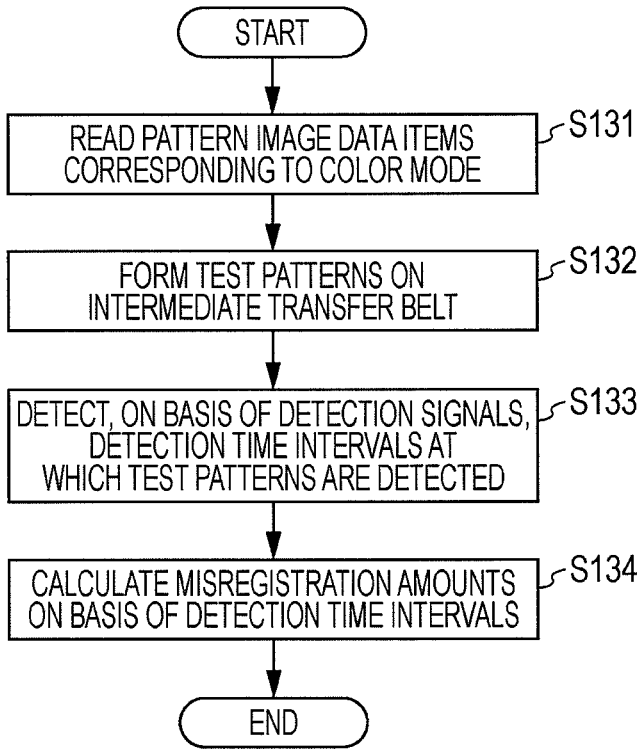
FIG. 7 illustrates an operation flow of a misregistration detection process of the image processing apparatus according to the exemplary embodiment.

Moreover, the control unit 101 performs control of moving the individual rolls described above, and performs the misregistration detection process. Here, the misregistration detection process will be described with reference to FIG. 7. The control unit 101 reads the pattern image data items corresponding to the specified color mode from the memory unit 102 (step S13). The control unit 101 supplies the individual pattern image data items, which have been read, to the respective image forming units 11 corresponding to the color mode that is stored in the RAM 101C, and forms toner images of the test patterns 610 on the basis of the pattern image data items for the individual colors on the intermediate transfer belt 12

(step S132). Then, the control unit 101 detects the toner images of the test patterns 610, which have been formed on the intermediate transfer belt 12, with the respective test-pattern detectors 600. Detection signals indicating detection of the test patterns 610 are output from the individual test-pattern detectors 600, and the correction part 105A of the image processing unit 105 detects detection time intervals, at which the test patterns 610 are detected, on the basis of the detection signals (step S133). The control unit 101 determines misregistration amounts for the individual colors on the basis of the respective detection time intervals, which have been detected in step S133 (step S134).

Returning to FIG. 6, the control unit 101 stores the misregistration amounts, which have been determined in step S13, in the RAM 101C (step S14). Furthermore, when no color mode has been specified in the misregistration correction instruction in step S12 (step S12: NO), the control unit 101 reads the color mode information item, which is stored in the memory unit 102, concerning a color mode that is set as the default. The control unit 101 performs movement control on the first transfer rolls 14 and the retract rolls 15 to 19 in accordance with the color mode that is set as the default, and performs the misregistration detection process (step S15). The control unit 101 performs movement control on each of the first transfer rolls 14 and the retract rolls 15 to 19 in accordance with the color mode that is set as the default, i.e., the four-color mode. More specifically, the control unit 101 outputs control signals for moving the photoconductor drums 31S1 and 31S2 for the specific colors, the first transfer rolls 14S1 and 14S2, which are disposed so as to face the photoconductor drums 31S1 and 31S2, respectively, and the retract rolls 15 and 16 in the downward direction, and for moving the photoconductor drums 31Y, 31M, 31C, and 31K, the first transfer rolls 14Y, 14M, 14C, and 14K, which are disposed so as to face the photoconductor drums 31Y, 31M, 31C, and 31K, respectively, and the retract rolls 17 to 19 in the upward direction to the movement mechanisms that are connected to the individual rolls. Accordingly, the photoconductor drums 31S1 for the first specific color S1 and the photoconductor drum 31S2 for the second specific color S2 and the intermediate transfer belt 12 are separated from each other, and only the photoconductor drums 31Y, 31M, 31C, and 31K for YMCK are caused to connect the intermediate transfer belt 12. Furthermore, the control unit 101 reads the pattern image data items corresponding to the color mode that is set as the default from the memory unit 102, and performs the misregistration detection process as in step S13 described above.

Note that the misregistration amounts stored in the RAM 101C are updated every time the misregistration detection process is performed in accordance with a user instruction or is automatically performed. Moreover, when the control unit 101 has not accepted an operation that has been performed by the user for the misregistration correction instruction in step S11 (step S11: NO), the control unit 101 terminates the misregistration detection process.

Figure 8:
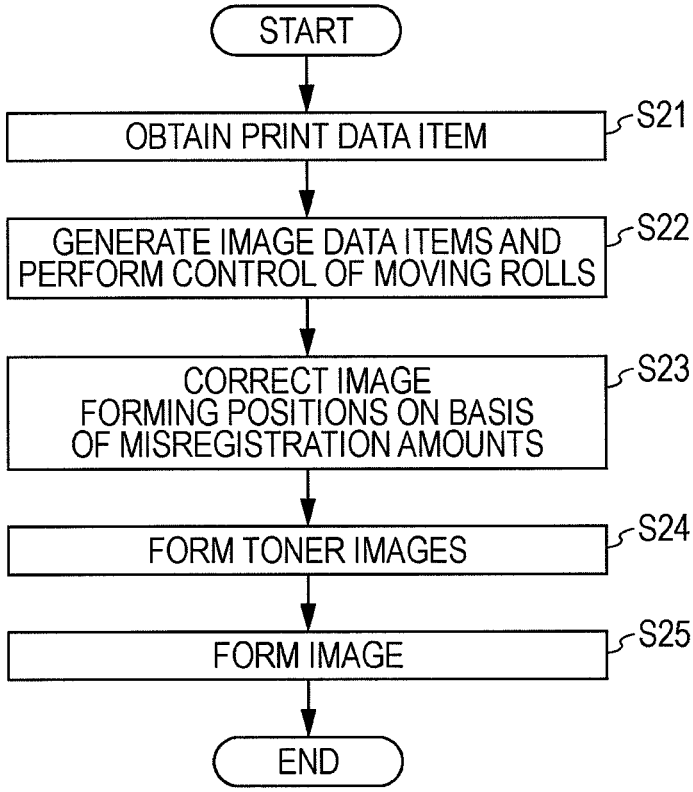
FIG. 8 illustrates an operation flow of an image forming process of the image processing apparatus according to the exemplary embodiment.

In this manner, while the image forming apparatus 1 is being on standby, the misregistration amounts in the color mode that is set as the default or in the color mode which has been specified by the user are detected. Hereinafter, a process in a case in which a print data item is transmitted from a PC or the like to the controller 4 of the image forming apparatus 1 after the misregistration detection process has been performed will be described with reference to FIG. 8.

When a print data item is obtained by the controller 4 (step S21), the controller 4 determines, on the basis of the print data item, a color mode for an image that should be formed. The controller 4 generates raster-image data items, and notifies the control unit 101 of the determined color mode. The control unit 101 outputs control signals for individually moving the first transfer rolls 14 and the retract rolls 15 to 19 in accordance with the color mode, which the control unit 101 has been notified of, to the movement mechanisms, and performs movement control on the individual rolls (step S22).

Then, the image forming positions of the raster-image data items are corrected by the correction part 105A on the basis of the misregistration amounts that are stored in the RAM 101C, and the raster-image data items are supplied to the individual image forming units 11 (step S23). Toner images are formed on the basis of the raster-image data items that have been supplied, and transferred onto the intermediate transfer belt 12 using first transfer (step S24). An image is formed on the sheet P, and the sheet P is ejected (step S25).

The misregistration detection and correction process in the present exemplary embodiment is described above. As described above, in the present exemplary embodiment, while the image forming apparatus 1 is being on standby, when the misregistration correction instruction is provided by the user, the misregistration amounts of tonner images that are to be transferred onto the intermediate transfer belt 12 using first transfer can be detected in a color mode that is specified by the user or in a color mode that is set as the default in advance. Accordingly, for example, a color mode that is set as the default or a color mode that the user frequently uses is set in the misregistration correction instruction. Thus, the image forming positions for a print data item are corrected on the basis of misregistration amounts that have been detected in the color mode which has been set, and color misregistration in a case in which an image is formed on the sheet P is reduced.

Modifications

One exemplary embodiment of the present invention is described above. However, the present invention is not limited to the above-described exemplary embodiment. Modifications given below are included in the present invention.

Figure 9:
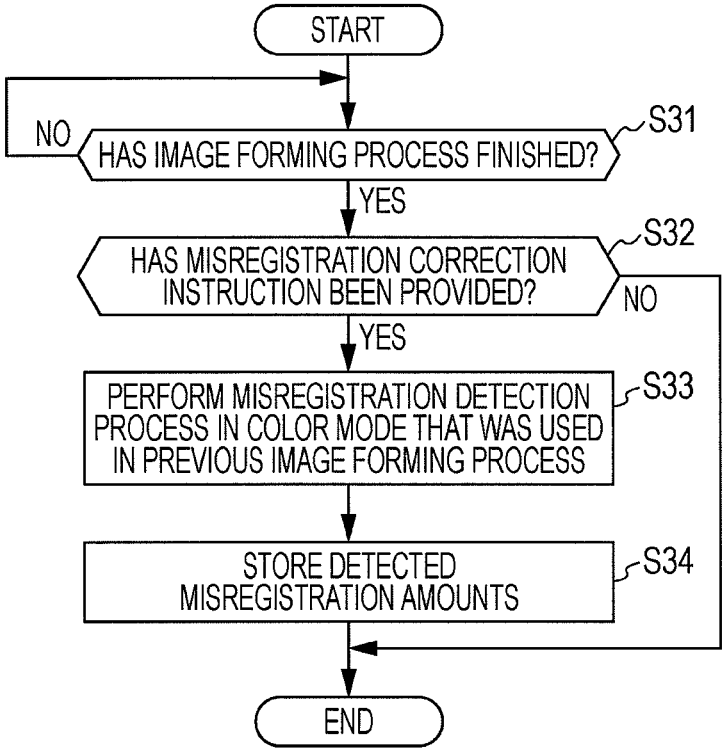
FIG. 9 illustrates an operation flow of the misregistration detection process in a first modification.

(1) In the exemplary embodiment described above, an example is described, in which the user provides the misregistration correction instruction before an image represented by a print data item is formed on the sheet P. However, after an image represented by a print data item is formed on the sheet P, selection of whether or not the misregistration correction instruction will be provided may be accepted from the user, and the misregistration detection process may be performed. Note that, in this case, the control unit 101 performs a process given below as a typical image forming process. The control unit 101 stores, in the RAM 101C, a color mode that is determined in accordance with a print data item which has been obtained by the controller 4. Then, the control unit 101 performs control of moving the first transfer rolls 14 and the retract rolls 15 to 19 in accordance with the color mode. The control unit 101 supplies, to the individual image forming units 11, raster-image data items that have been generated by the controller 4, and forms toner images. After the control unit 101 transfers the tonner images onto the intermediate transfer belt 12 using first transfer, the control unit 101 forms an image on the sheet P, and ejects the sheet P. Hereinafter, a process performed after an image has been formed on the sheet P will be described with reference to FIG. 9.

When an image forming process of forming an image on the sheet P has finished (step S31: YES), the control unit 101 displays, on the operation unit 103, a message for accepting selection of whether or not correction of misregistration will be performed. Then, when the control unit 101 has accepted a selection operation indicating that the misregistration correction instruction is provided (step S32: YES), the control unit 101 reads a color mode that was used in the previous image forming process from the RAM 101C. Then, the control unit 101 performs control of moving the first transfer rolls 14 and the retract rolls 15 to 19 in accordance with the color mode. As in the exemplary embodiment, the control unit 101 transfers the test patterns 610, which are based on the pattern image data items corresponding to the color mode, onto the intermediate transfer belt 12 using first transfer with the image forming units 11. Then, the control unit 101 detects misregistration amounts with the image processing unit 105 on the basis of detection signals indicating detection of the test patterns 610 that have been detected by the misregistration detecting unit 104 (step S33). The control unit 101 stores the detected misregistration amounts in the RAM 101C (step S34). Note that the control unit 101 is on standby in step S31 until the image forming process finishes (step S31: NO). When the misregistration correction instruction has not been provided in step S32 (step S32: NO), the control unit 101 discards the color mode that is stored in the RAM 101C, and terminates the process. Note that a process of correcting the image forming positions for a print data item is performed as in the exemplary embodiment after the misregistration detection process has been performed.

Figure 10:
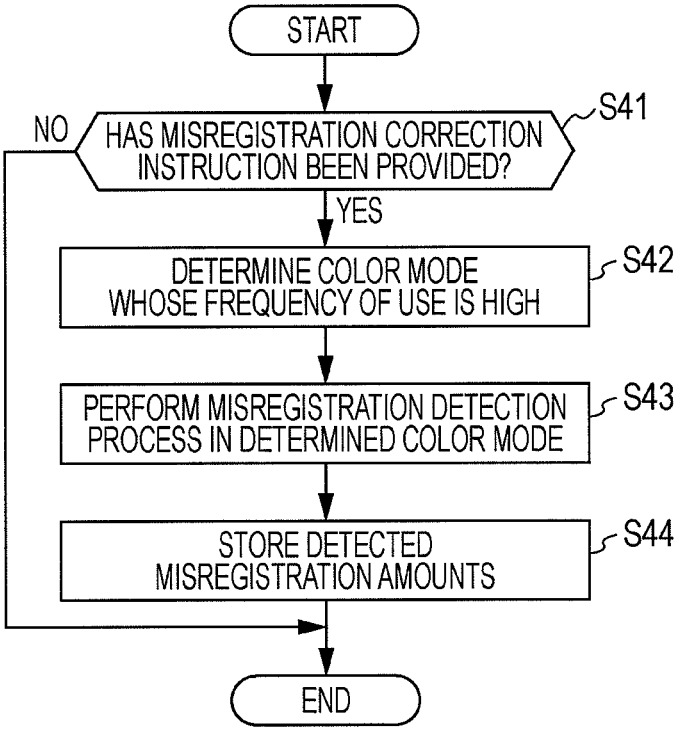
FIG. 10 illustrates an operation flow of the misregistration detection process in a second modification.

(2) In the above-described exemplary embodiment, an example is described, in which, when the misregistration correction instruction is provided while the image forming apparatus 1 is being on standby, the misregistration detection process is performed using a color mode that is set as the default or a color mode that is specified by the user. However, the misregistration detection process may be performed in a color mode whose frequency of use in image forming is highest. In this case, an image formed on one sheet is determined as one unit, and the control unit 101 counts, in the units, the number of images that are obtained by forming toner images which have been formed by the image forming units 11 on sheets, thereby counting the number of printed sheets in each of the color modes. A result of counting the numbers of printed sheets is stored in the memory unit 102. Hereinafter, an operation for the misregistration detection process in this case will be described with reference to FIG. 10.

When the misregistration correction instruction has been provided via the operation unit 103 (step S41: YES), the control unit 101 determines a color mode (hereinafter, referred to as a "high-frequency color mode") in which the number of printed sheets on which images are formed is highest among the numbers of printed sheets stored in the memory unit 102, and stores the color mode in the RAM 101C (step S42). Then, the control unit 101 performs control of moving the first transfer rolls 14 and the retract rolls 15 to 19 in accordance with the high-frequency color mode, which is stored in the RAM 101C. As in the exemplary embodiment, the test patterns 610, which are based on the pattern image data items corresponding to the high-frequency color mode, are transferred onto the intermediate transfer belt 12 using first transfer. Then, the control unit 101 detects misregistration amounts with the image processing unit 105 on the basis of detection signals indicating detection of the test patterns 610 that have been detected by the misregistration detecting unit 104 (step S43). The control unit 101 stores the detected misregistration amounts in the RAM 101C (step S44). Furthermore, When the misregistration correction instruction has not been provided in step S41 (step S41: NO), the control unit 101 terminates the process without performing the misregistration detection process. Note that a process of correcting the image forming positions for a print data item is performed as in the exemplary embodiment after the misregistration detection process has been performed.

(3) Furthermore, in the above-described exemplary embodiment, an example is described, in which the individual image forming units 11 for the six colors are attached to the image forming apparatus 1 in advance. However, for example, there is a case in which only the image forming units 11 for the four colors, i.e., YMCK, are attached to the image forming apparatus 1. In this case, detection mechanisms that detect whether or not the image forming units 11 are attached may be provided in the attachment parts used to attach the image forming units 11 for the individual colors, and the misregistration detection process may be performed in accordance with colors of images that can be formed by the detected image forming units 11. Note that, in this case, color information items that are defined in advance in accordance with combinations of the attached image forming units 11 are stored in the memory unit 102. In other words, for combinations of colors that are determined in accordance with the combinations of the attached image forming units 11, the six-color mode is stored in association with the combination of the image forming units 11 for the six colors. The five-color mode #1 is stored in association with the combination of the image forming units 11 for YMCK and the first specific color S1. The five-color mode #2 is stored in association with the combination of the image forming units 11 for YMCK and the second specific color S2. The four-color mode is stored in association with only the combination of the image forming units 11 for YMCK. The two-color mode is stored in association with the combination of only the image forming units 11 for the first specific color S1 and the second specific color S2.

Figure 11:
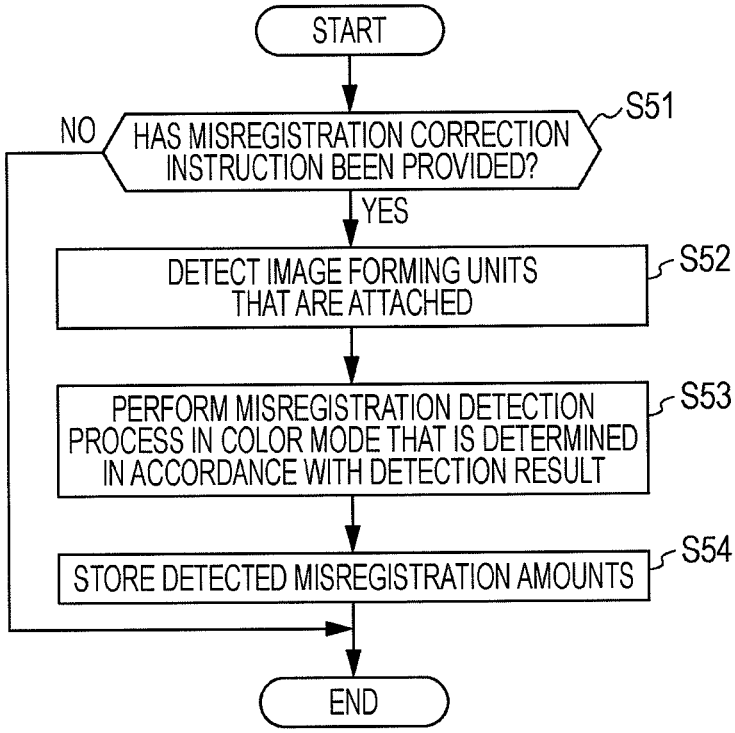
FIG. 11 illustrates an operation flow of the misregistration detection process in a third modification.

Hereinafter, an operation for the misregistration detection process in this case will be described with reference to FIG. 11. When the misregistration correction instruction has been provided via the operation unit 103 (step S51: YES), the control unit 101 detects, with the detection mechanisms, the image forming units 11 that are attached (step S52). Then, the control unit 101 reads, from the memory unit 102, a color mode corresponding to the image forming units 11 that have been detected in step S52, and stores the color mode in the RAM 101C. The control unit 101 performs control of moving the first transfer rolls 14 and the retract rolls 15 to 19 in accordance with the color mode. As in the exemplary embodiment, the control unit 101 transfers the test patterns 610, which are based on the pattern image data items corresponding to the color mode, onto the intermediate transfer belt 12 using first transfer with the image forming units 11. Then, the control unit 101 detects misregistration amounts with the image processing unit 105 on the basis of detection signals indicating detection of the test patterns 610 that have been detected by the misregistration detecting unit 104 (step S53). The control unit 101 stores the detected misregistration amounts in the RAM 101C (step S54). Furthermore, when the misregistration correction instruction has not been provided in step S51 (step S51: NO), the control unit 101 terminates the process without performing the misregistration detection process. Note that a process of correcting the image forming positions for a print data item is performed as in the exemplary embodiment after the misregistration detection process has been performed.

(4) In the above-described exemplary embodiment, an example is described, in which, when the misregistration correction instruction is provided by the user while the image forming apparatus 1 is not performing an image forming process, i.e., while the image forming apparatus 1 is being on standby, the misregistration detection process is performed in a color mode that is set as the default or a color mode that is specified by the user. However, for example, in a case in which a color mode in which image forming is performed using two or more colors is set as the default, if the misregistration correction instruction is not provided within a predetermined time period while the image forming apparatus 1 is being on standby, the misregistration detection process may be performed in the color mode that is set as the default.

(5) The above-described program to be executed by the CPU 101A may be provided in a state in which the program is stored in a computer-readable recording medium, such as a magnetic recording medium (a magnetic tape, a magnetic disk (a hard disk drive (HDD) or a flexible disk (FD)), or the like), an optical recording medium (an optical disk (a compact disc (CD) or a digital versatile disk (DVD)), or the like), a magneto-optical recording medium, or a semiconductor memory, and may be installed in each apparatus. Alternatively, the program may be downloaded and installed into each apparatus through communication lines.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of toner-image forming units that form electrostatic latent images on image carriers by performing exposure in accordance with image data which is supplied, and that form toner images by developing the electrostatic latent images;

an intermediate transfer body onto which the toner images formed by the plurality of toner-image forming units are transferred;

a controller that performs control of causing at least one of the plurality of toner-image forming units to be used to form the toner images and the intermediate transfer body to contact each other, and control of separating the plurality of toner-image forming units except the at least one of the plurality of toner-image forming units and the intermediate transfer body from each other;

a detector that detects a test pattern formed by the plurality of toner-image forming units;

an instruction acceptance unit that accepts an instruction for performing a detection process with the detector; and a memory that stores a first forming mode, which is used to form an image, among a plurality of forming modes indicating combinations of toner-image forming units to be used to form the toner images among the plurality of toner-image forming units, and that stores a second forming mode, which is used to form the test pattern, among the plurality of forming modes, wherein, when the instruction acceptance unit accepts the instruction, the test pattern is formed using at least one of the plurality of toner-image forming units corresponding to the second forming mode stored in the memory, and is detected by the detector.

2. The image forming apparatus according to claim 1, further comprising a mode acceptance unit that accepts the second forming mode which is input as an input and which is to be stored in the memory.

3. The image forming apparatus according to claim 1, wherein the memory stores, as the second forming mode, a forming mode whose frequency of use in image forming is highest.

4. The image forming apparatus according to claim 1, further comprising a storage unit that stores the number of times an image is formed for each of the plurality of forming modes, wherein, in the memory, a forming mode corresponding to a highest number of times that is stored in the storage unit is stored as the second forming mode.

5. The image forming apparatus according to claim 1, wherein each of the plurality of toner-image forming units is detachably attached to a body of the image forming apparatus, and wherein the image forming apparatus further comprises a detection unit that detects the plurality of toner-image forming units which are attached to the body of the image forming apparatus, and a mode determination unit that determines a forming mode in accordance with colors of the toner images which are able to be formed by the plurality of toner-image forming units detected by the detection unit, and that causes the memory to store the determined forming mode.

6. An image processing method comprising:

forming, using a plurality of toner-image forming units, electrostatic latent images on image carriers by performing exposure in accordance with image data which is supplied, and forming toner images by developing the electrostatic latent images;

transferring the toner images, which have been formed in the forming, onto an intermediate transfer body;

performing control of causing at least one of the plurality of toner-image forming units to be used to form the toner images and the intermediate transfer body to contact each other, and control of separating the plurality of toner-image forming units except the at least one of the plurality of toner-image forming units and the intermediate transfer body from each other;

detecting a test pattern that is formed in the forming;

accepting an instruction for performing a detection process in the detecting; and storing a first forming mode, which is used to form an image, among a plurality of forming modes indicating combinations of toner-image forming units to be used to form the toner images among the plurality of toner-image forming units, and storing a second forming mode, which is used to form the test pattern, among the plurality of forming modes, wherein, when the instruction is accepted in the accepting, the test pattern is formed using at least one of the plurality of toner-image forming units corresponding to the second forming mode stored in the storing, and is detected in the detecting.

* * * * *